US006220433B1

(12) United States Patent
Kang

(10) Patent No.: US 6,220,433 B1
(45) Date of Patent: Apr. 24, 2001

(54) GOLF BAG WITH STAND DEVICE TO MAINTAIN BAG TOWARDS UPRIGHT POSITION

(76) Inventor: Pan-gyu Kang, 916-62, Taechi-dong, Kangnam-ku, Seoul (KR)

( * ) Notice: Subject to any disclaimer, the term of this patent is extended or adjusted under 35 U.S.C. 154(b) by 0 days.

(21) Appl. No.: 09/289,694

(22) Filed: Apr. 9, 1999

(30) Foreign Application Priority Data

Jul. 13, 1998 (KR) ..... 98-12869
Dec. 18, 1998 (KR) ..... 98-25560

(51) Int. Cl.[7] ..... A63B 55/06; A63B 55/10

(52) U.S. Cl. ..... 206/315.7; 206/315.8; 248/96

(58) Field of Search ..... 206/315.7, 315.8; 248/96

(56) References Cited

U.S. PATENT DOCUMENTS 1,924,182 * 8/1933 Fritz ..... 206/315.7 X
2,564,917 * 8/1951 Oberlies, Sr. ..... 248/96
4,921,192 * 5/1990 Jones ..... 248/96
5,156,366 * 10/1992 Anderson ..... 248/96
5,209,350 * 5/1993 Maeng ..... 206/315.7
5,356,003 * 10/1994 Gretz et al. ..... 206/315.7
5,407,155 * 4/1995 Chung ..... 206/315.7 X
5,415,285 * 5/1995 Reimers ..... 206/315.3 X
5,678,791 * 10/1997 Maeng ..... 206/315.7 X
5,718,401 * 2/1998 Walters ..... 248/96 X
5,762,189 * 6/1998 Reimers ..... 206/315.7
5,799,786 * 9/1998 Beck et al. ..... 206/315.7
5,816,544 * 10/1998 Hsieh ..... 206/315.7 X
5,823,485 * 10/1998 Park ..... 206/315.7 X
5,829,719 * 11/1998 Han ..... 206/315.7 X
5,857,467 * 1/1999 Cheng ..... 206/315.7
5,857,567 * 1/1999 Cheng ..... 206/315.7
5,887,833 * 3/1999 Sundara et al. ..... 206/315.7 X
5,901,845 * 5/1999 Cheng ..... 206/315.7

* cited by examiner

*Primary Examiner*—Sue A. Weaver
(74) *Attorney, Agent, or Firm*—Blakely Sokoloff Taylor & Zafman

(57) ABSTRACT

The invention includes a golf bag. The golf bag includes a body, a first support member, and a first elastic link member. The body defines an upper portion and a lower portion. The lower portion includes a resilient pressing member. The resilient pressing member includes a fixed end and a free end, where the fixed end is fixed to the lower portion of the body within the perimeter of the lower portion. The first support member includes a first end coupled to the upper portion so as to pivot. The first elastic link member includes a first end that is coupled to the first support member at a location that is between the first end as a second end of the first support member. Moreover, the second end of the first elastic link member is coupled to the free end of the resilient pressing member.

11 Claims, 18 Drawing Sheets

GOLF BAG WITH STAND DEVICE TO MAINTAIN BAG TOWARDS UPRIGHT POSITION

CROSS-REFERENCES TO RELATED APPLICATIONS

This application is based on Nos. 98-12869 and 98-25560 filed in the Korean Industrial Property Office on Jul. 13, 1998 and Dec. 18, 1998, respectively.

BACKGROUND OF THE INVENTION (a) Field of the Invention

The present invention includes a golf bag, particularly to the golf bag structured such that a support member is unfolded corresponding to the inclination of the lower body resting on the ground.

(b) Description of the Related Art

Generally, a golf bag is for carrying or safe-keeping a plurality of golf clubs.

The golf bags may be divided into two types according to a support method thereof:

The first type is a golf bag wherein the bottom face thereof is supported by the ground surface while the same is in an upright position; and The second type is a golf bag wherein the bottom face thereof is supported by the ground surface while the same is in an inclined position.

With the golf bag of the second type, the cylindrical body of the conventional golf bag, shown in FIG. 17. and FIG. 18. is structured such that the upper and lower portions thereof are opened.

In the upper portion of the upper body 101 is mounted an upper plate 103 whereto a hinge assembly 107 mounted in an aspect of the upper portion is rotatably hinged, and a bottom plate 105 is mounted in a lower portion of the upper body.

A support leg 109 for supporting the upper body 101 when unfolded corresponding to a slant of the upper body 101 is fixed to the hinge assembly 107.

An elastic link member 111 for rotating the hinge assembly 107 when pushed upward corresponding to a slant of the upper body 101 is coupled to the upper body, and a pressing member 113 for pushing up the link 111 corresponding to a slant of the upper body is mounted in one aspect of the bottom plate 115.

The link 111 is pushed up by a pressing power imposed thereon when the pressing member 113 contacts the ground surface according to a slant of the upper plate 103, and here the upper body 101 is tilted on the pressing member 113.

The support leg 109 is unfolded when the linear movement of the elastic link 111 turns into a rotation movement of the hinge assembly 107 and thus, the unfolded support leg 109 supports the main body 101.

A conventional golf bag, wherein the pressing member is coupled thereon either by mounting the same to one aspect of the bottom plate or with other fixing apparatus, is structured such that the bottom plate has a prominent configuration, with the result that problems arise such as increased assembly processing steps, a poor product design, increased manufacturing cost, and frequent product defects.

SUMMARY OF THE INVENTION

The present invention is provided to solve the problems of the conventional golf bag.

According to the purpose of the present invention, there is proposed a golf bag wherein the same is structured such that a support member is unfolded when a lower body is tilted on the ground, with the results of minimum assembly processing steps, a fine configuration view, a reduced manufacturing cost, and minimized product defects.

The present invention to achieve the above purpose comprises:

an upper body with a cylindrical structure;

a frame mounted in an upper body for maintaining a configuration of the golf bag despite an external force from or a weight of the golf-clubs collected inside the upper body;

a lower body mounted in the lower portion of the upper body for being a bottom portion of the golf bag encircling the lower portion of the upper body;

more-than-one hinge members in hinged connection with an upper fixed member that is fixed on the upper body;

support members connected to the free ends of the hinge member for supporting the golf bag at a predetermined angle when unfolded corresponding to a slant of the upper body;

a means wherein concerning the above support members, the support members are folded when the lower body is off the ground surface, and the same is unfolded when the lower body is on the ground surface.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The following is a detailed description of a structure and operation of the present invention with reference to appended drawings.

Figure 1:
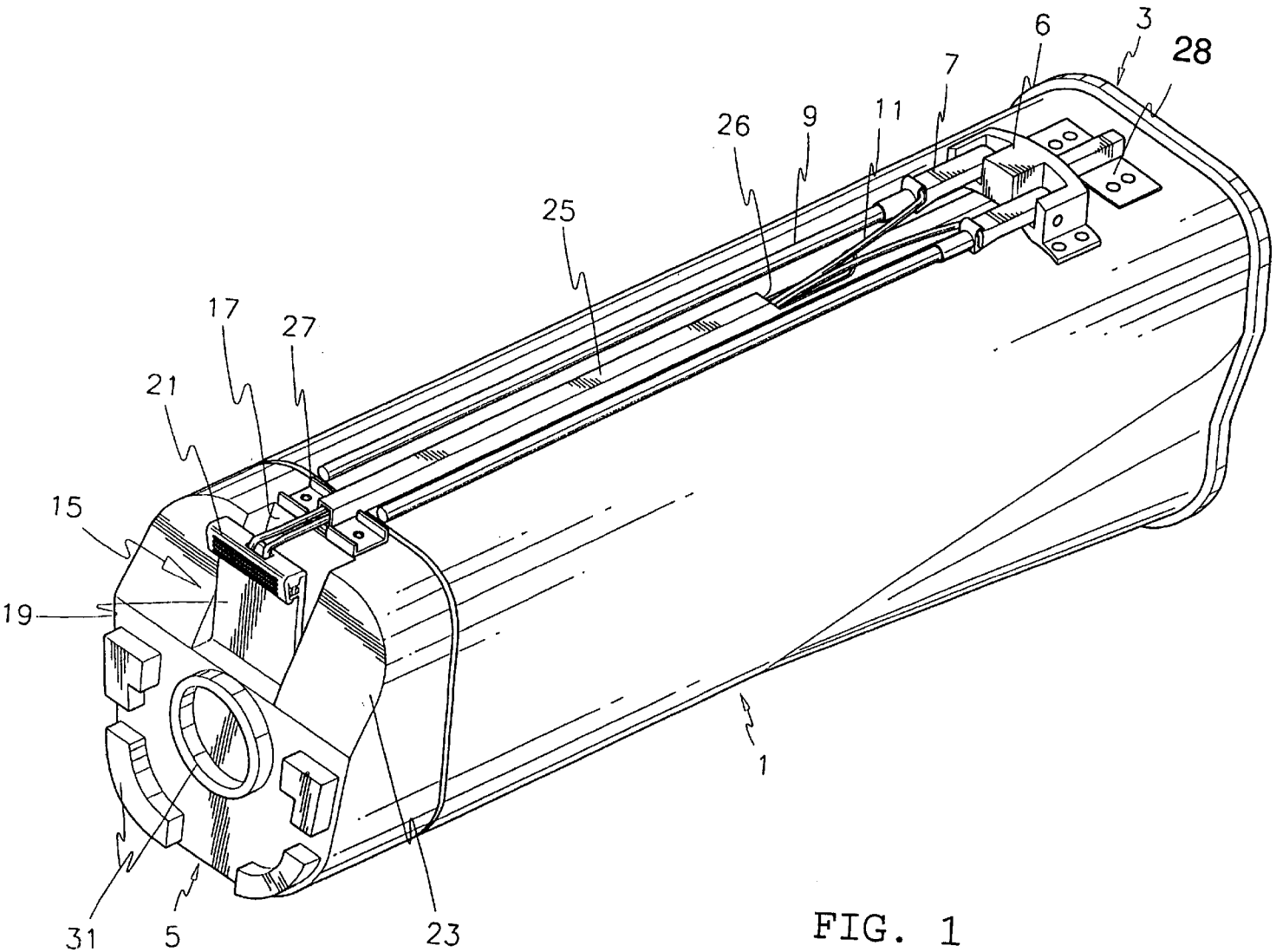
FIG. 1 is a perspective view showing the first embodiment of the present invention.
Figure 7:
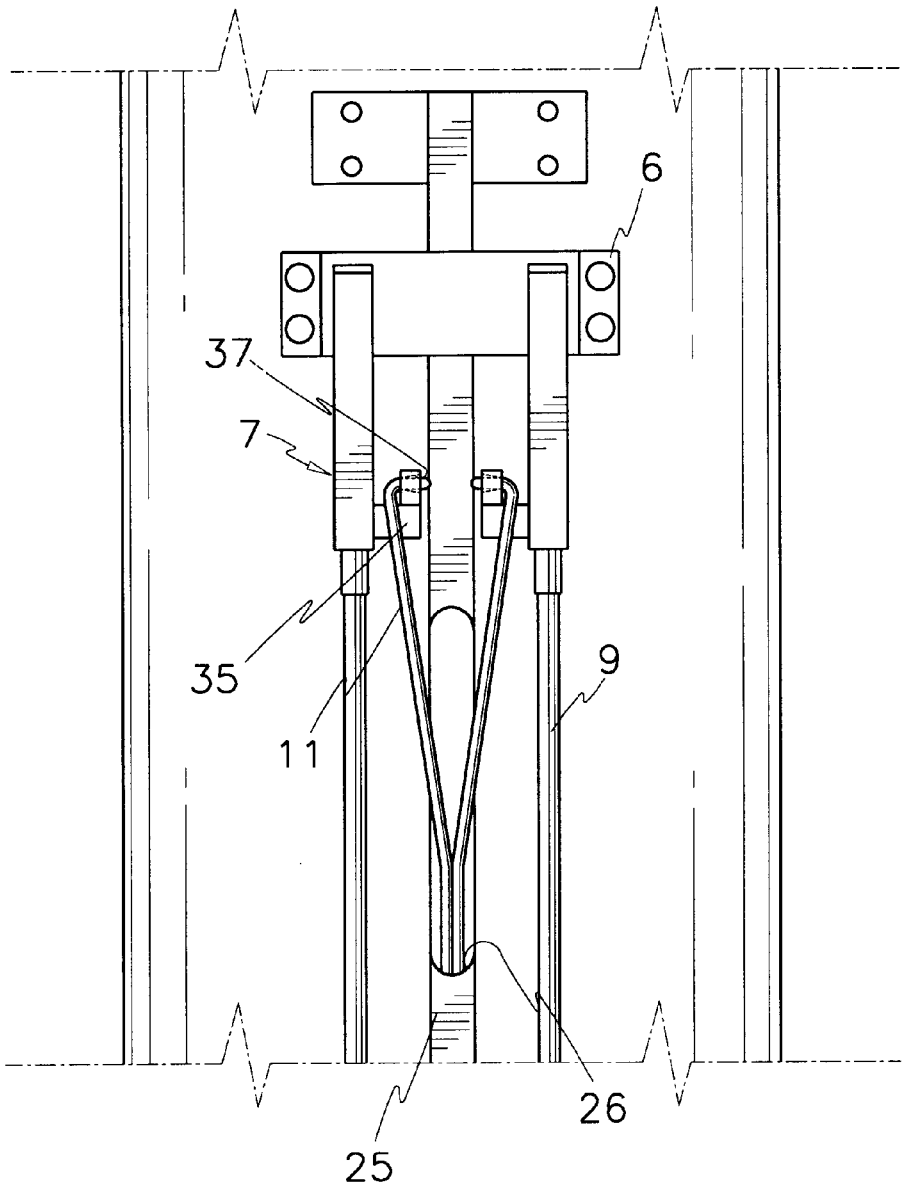
FIG. 7 is a partial front view showing other coupling structure of a elastic link member according to the first embodiment of the present invention.

A golf bag, according to the first embodiment of the present invention shown in FIG. 1. through FIG. 7., comprises:

An upper body 1 with a cylindrical structure;

A frame 3 mounted in a top portion of the upper body for maintaining a fine configuration of a golf bag despite an external force from or a weight of golf-clubs secured inside the upper body 1; and A lower body 5 mounted in a lower portion of the upper body for forming a bottom part of the golf bag encircling the lower portion of the upper body.

An upper fixed body 6 bonded on some aspect of the upper body 1 is in hinged connection with more-than-one hinge members 7, and support members 9 connected to free ends of the hinge members 7 are unfolded corresponding to a slanting of the upper body 1 to support the golf bag at a predetermined angle.

This support member 9 relates to a stand device 15 wherein the support member 9 is folded when the lower body 5 of the golf bag is off the ground, but the same is unfolded when on the ground.

The stand device 15 comprises an elastic link member 11 either connected to the hinge member 7 or to the support member 9 respectively, or to a coupling portion of the two members; and a pressing member 19 for pushing up the elastic link member 11 to unfold the support member 9.

The elastic link member 11, when the lower body is off the ground, forces the hinged member 7 back to an initial position by a self-elastic force thereof, whereby the support member 9 is folded.

The lower body 5 has a slanted portion 23 wherethrough the pressing member 19 can push up the elastic member 11 when the lower body 5 contacts the ground.

The slanted portion comprises a pressing member 19 detachably connected thereto; and an allowance space 17 wherein the pressing member 19 can move a predetermined distance when the slanted portion 23 is on or off the ground surface.

The elastic link member 11 is provided with a guide to enable the elastic link members 11 to be arranged in order to make a shortest possible linear movement when the pressing member 19 is in or out of contact with the ground surface.

The guide means comprises a guide member 25 whereinto the elastic link member 11 of a predetermined length is inserted, the guide member 25 making it possible for the elastic link member 11 to make a shortest possible linear movement without collapse when forced to make a linear movement by the pressing member 19.

The guide member 25 is formed in a tube unit wherethrough the elastic link member 11 makes a linear movement.

The guide member 25 shown in FIG. 1. is formed in a rectangular shape. However, any shape of the guide member 25 including a cylinder or a polygon can be applied for the same as far as the elastic link member 11 can make a linear movement without collapse.

The guide member 25 has an open portion 26 whereat when the pressing member 19 is pushed up, the elastic link members 11 make a proper divergence, and when the pressing member 19 goes downward, the same is arranged in order.

The open portion 26 is formed at a predetermined point of the guide member 25, so that the elastic link members 11 are properly diverged and arranged in order.

The top and bottom portion of the guide member 25, as shown in FIG. 1., are bolted to the upper body 1 and to the lower body 5 respectively through a bottom fixed member 27 and a top fixed member 28.

Figure 6:
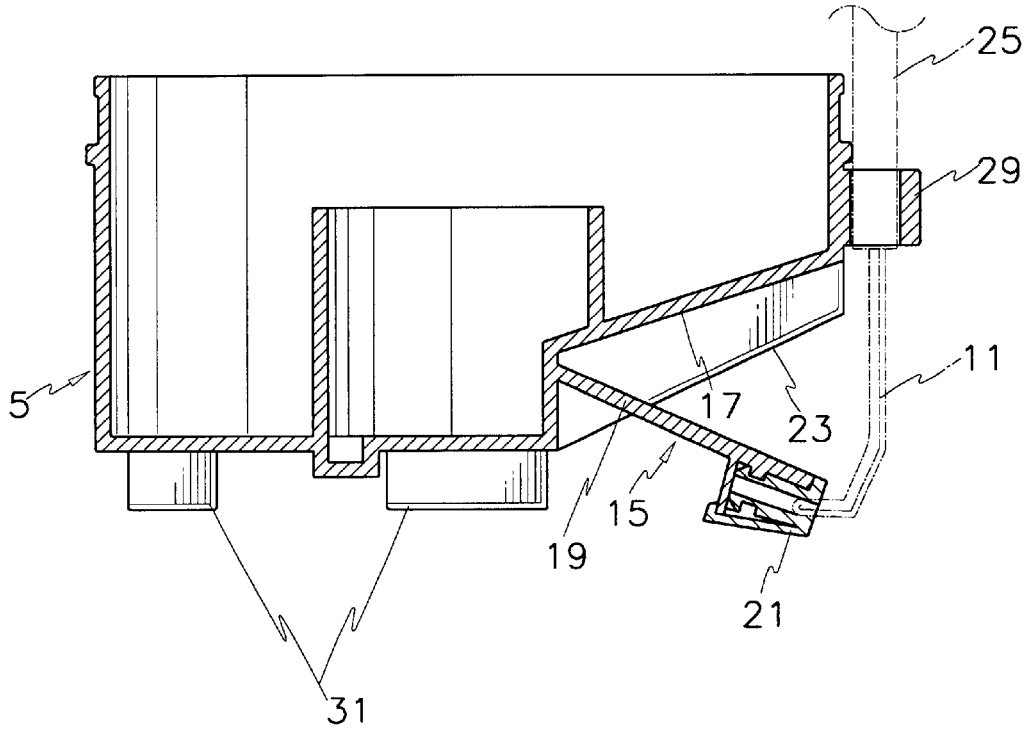
FIG. 6 is a partial sectional view showing other coupling structure of a guide member according to the first embodiment of the present invention.

The bottom portion of the guide member 25, as shown in FIG. 6., may be connected by a forcing insertion thereof into a coupling unit provided on a portion of the lower body 5.

Figure 2:
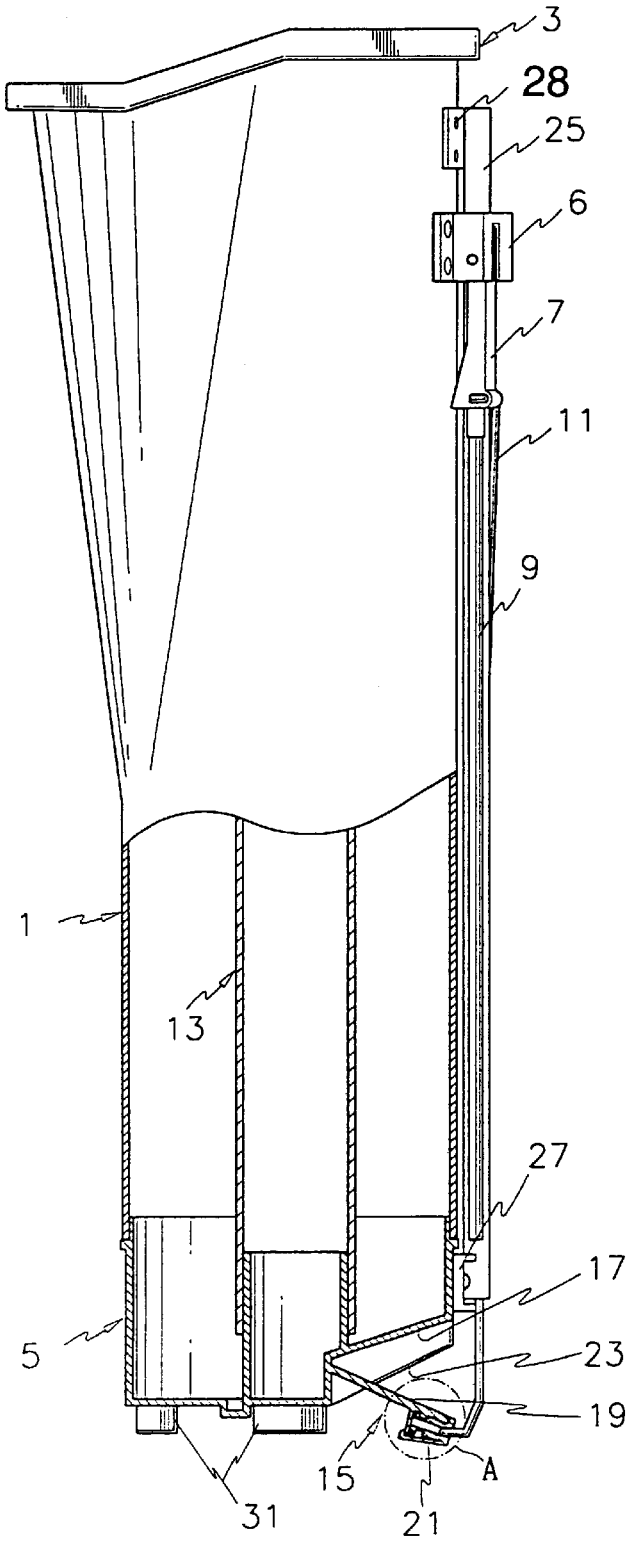
FIG. 2 is a partial sectional view showing the first embodiment of the present invention.

Prop members 13 as seen in FIG. 2 for supporting the upper body are coupled to predetermined portions in the lower body 5 to prevent an enmeshment among golf-clubs orderly divided through the frame 3.

The pressing member 19 is coupled to a connection member 21 for making the pressing member and the elastic link member work interlockingly when the pressing member 19 contacts or separates from the ground.

Figure 3:
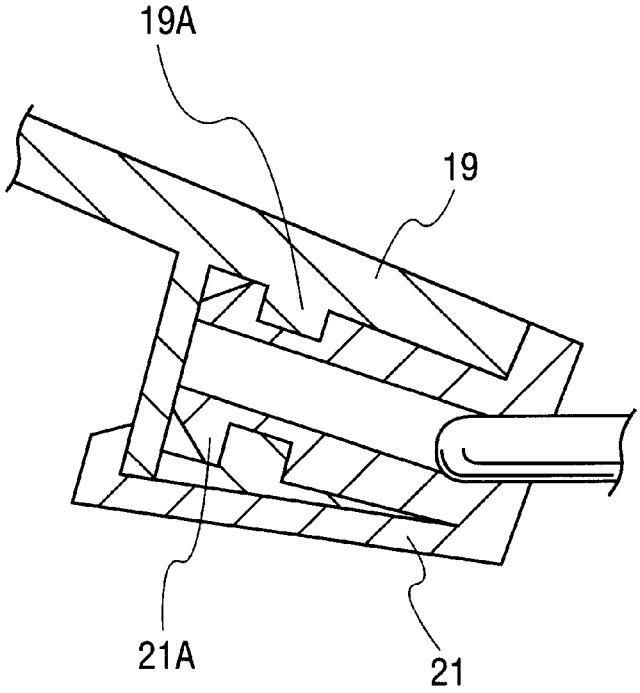
FIG. 3 is an enlarged view of a detail A in FIG. 2.

A hook projection 21*a* formed in the connection member 21, as shown in the FIG. 3, is hooked into a hooking groove 19*a* formed in the pressing member 19. However an-other-way-around process is possible wherein the hook projection (not shown here) formed in the pressing member 19 is hooked into the hooking groove (not shown here) formed in the connection member 21.

A plurality of pad members 31 for reinforcing stiffness of the lower body 5 and supporting the same 5 are formed in the bottom face of the lower body 5.

Figure 4:
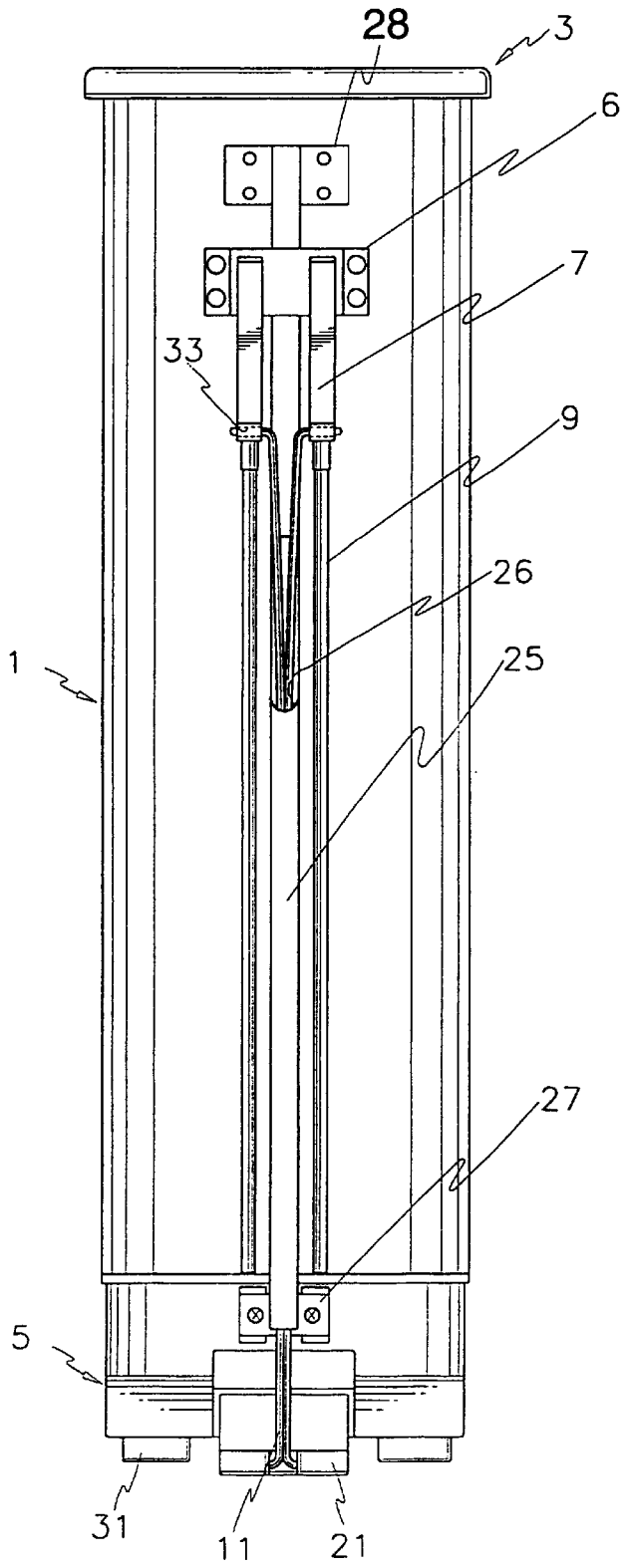
FIG. 4 is a front view showing the first embodiment of the present invention.

The elastic link member 11, shown in FIG. 1. and FIG. 4., is coupled into a hinge hole 33 provided in the hinge member such that each of the elastic link members is extended outwardly in a bent state, or reversely, such that each of the same is directed toward the inner side of the hinge hole 37 and the hinge member 7, as shown in FIG. 7.

The hinge hole 37 is formed in a coupling member 35 provided in an end side portion of the hinge member 7.

When the golf bag, by moving the upper body 1 or the frame 3, is inclined toward the slanted portion 23, the slanted portion 23 of the lower body 5 and the pressing member 19 move towards the ground surface.

The elastic link member 11 is elevated by a displacement imposed on the pressing member 19 connected in the allowance space when the pressing member 19 touches the ground.

At this point, the elastic link member 11 is subjected to a linear movement through the guide member 25 of the guide means and rises along the shortest possible reciprocal path, followed by extending out from an open portion 26 toward the outside of the hinge member 7.

According to elevation and extension of the elastic link member 11, a linear motion of the elastic link member 11 turns into a rotation of the hinge member 7. And thereby the hinge member 7 rotates the support member 9. Consequently, the support member 9 is unfolded.

Figure 5:
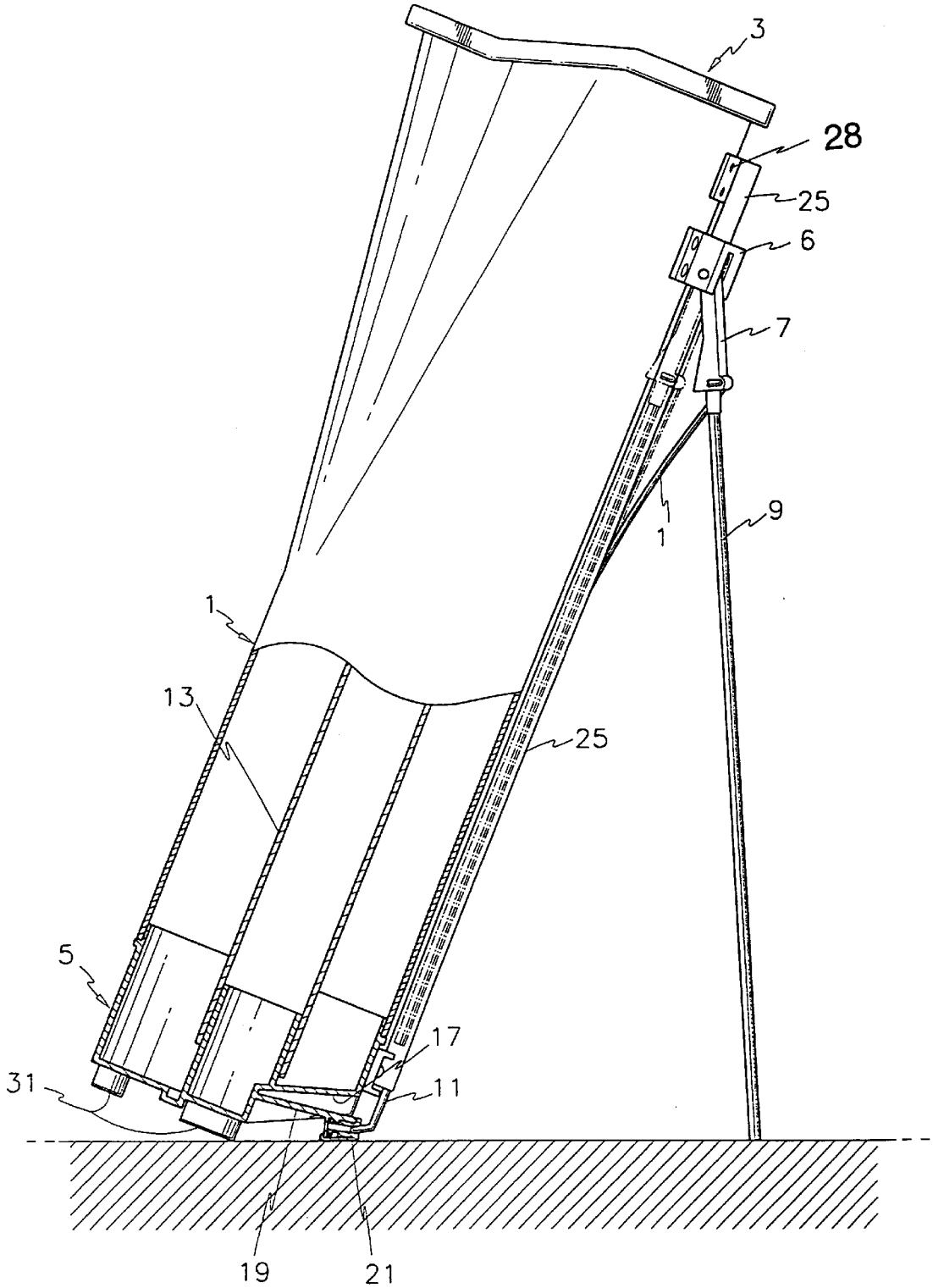
FIG. 5 is a partial sectional view showing the first embodiment of the present invention in operation.

Accordingly, the support members 9, as shown in FIG. 5., upholds the upper body 5 standing slanted at a predetermined angle while the free ends thereof contact the ground surface together with the bottom face.

Figure 8:
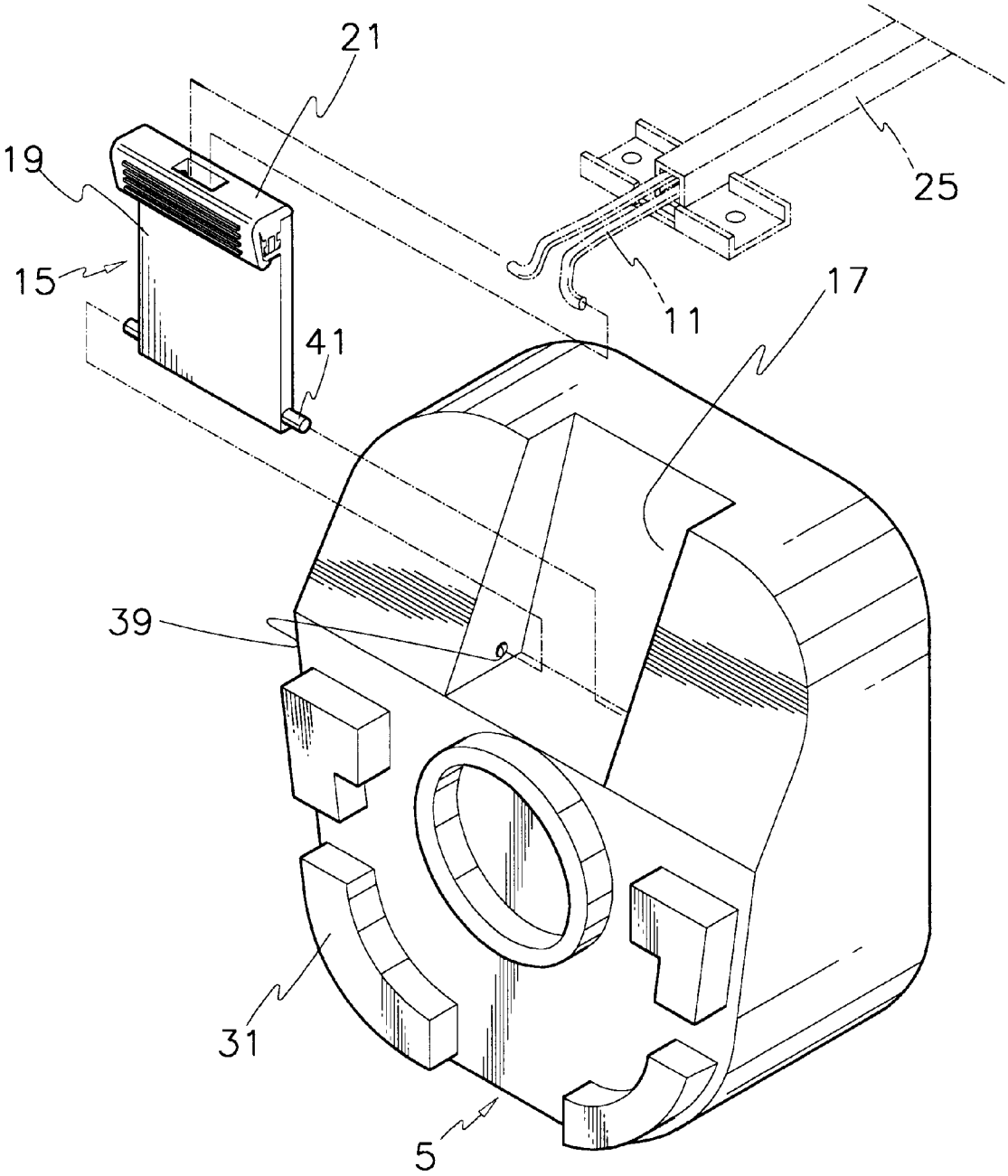
FIG. 8 is a perspective view showing a golf bag according to the second embodiment of the present invention.

A golf bag according to the second embodiment of the present invention, identical to the first embodiment other than the following description, is shown in FIG. 8.

The hinge holes 39 formed in the allowance space 17 at a predetermined interval are hinged with a hinge axis 41 such that the hinge axis 41 is allowed to rotate. And the hinge axis 41 is formed as a protrusion out of the pressing member 19 so that the pressing member 19 may be detachably connected to the lower body 5.

On the other hand, the hinge holes (not shown here) are formed in end sides of the pressing member 19, and the hinge axis (not shown here) being rotatably hinged into the hinge holes is formed as a protrusion in the allowance space 17 so that the pressing member 19 may be detachably connected.

Figure 9:
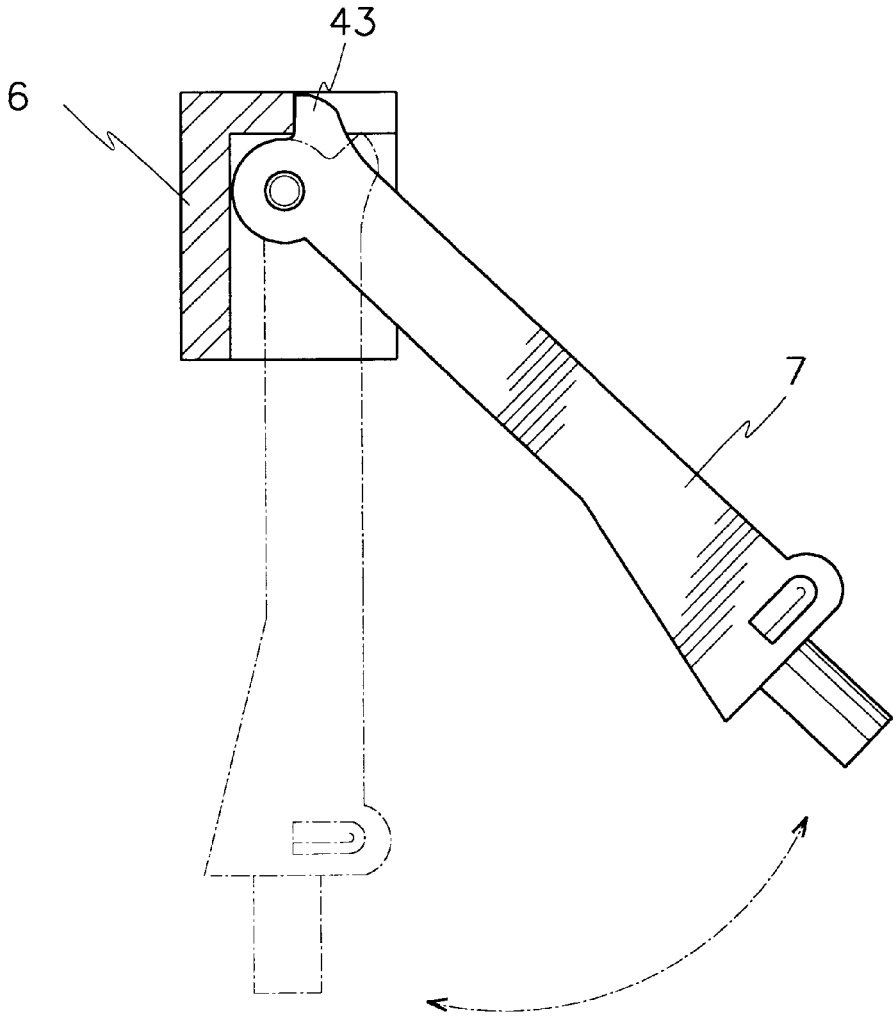
FIG. 9 is a partial sectional view showing a golf bag according to the third embodiment of the present invention.

A partial selected view of a golf bag according to the third embodiment of the present invention, the third embodiment of the present invention being identical to the first embodiment other than the following description, is shown in FIG. 9.

A stopper 43 is a protruding shape for stopping the rotation of the hinge member 7 at a predetermined angle whereat the stopper comes into contact with the upper fixed member 6 and thus obstructs the rotation of the hinge member 7, the stopper 43 being formed at one end portion of the hinge member 7.

Figure 10:
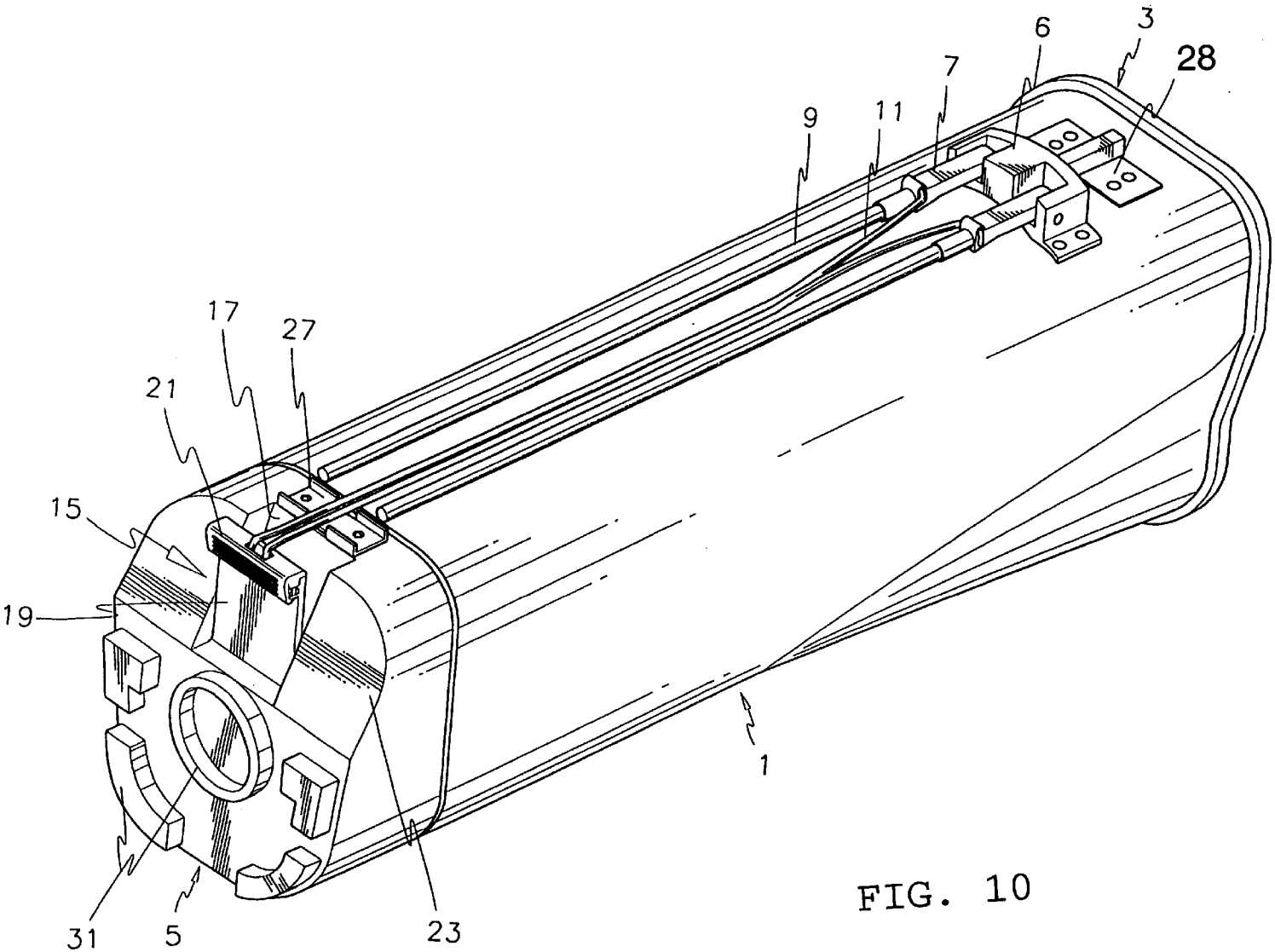
FIG. 10 is a perspective view showing a golf bag according to the fourth embodiment of the present invention.

A detail of a golf bag according to the fourth embodiment of the present invention, identical to the first embodiment other than the following description, is shown in FIG. 10.

The elastic link member 11 of the present fourth embodiment, wherein the same 11 is supposed to make a linear movement without a guide means unlike in the first embodiment, has a predetermined length of unbent and fixed portion thereof.

Figure 11:
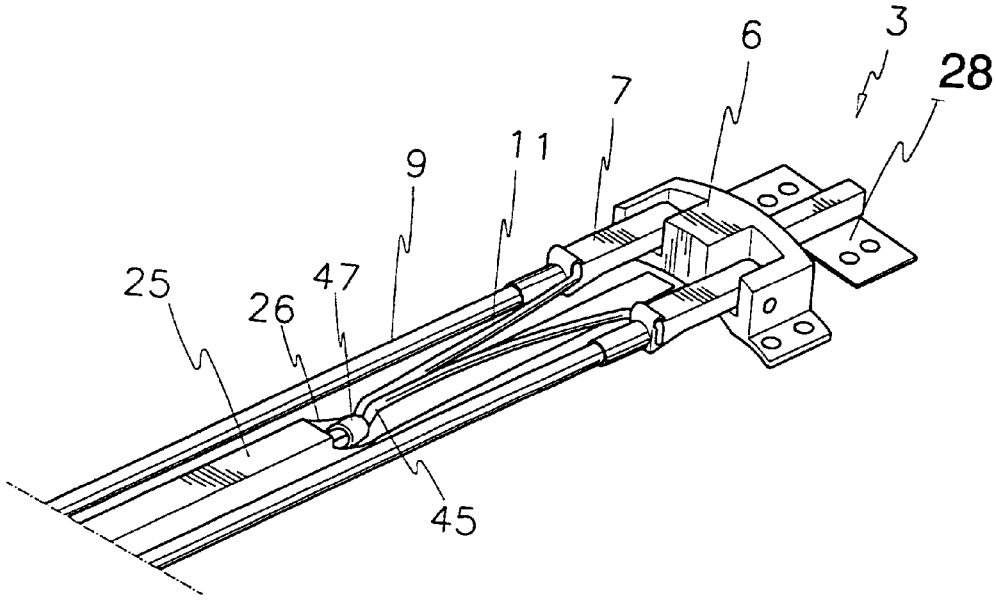
FIG. 11 is a partial front view showing a golf bag according to the fifth embodiment of the present invention.

A golf bag according to the fifth embodiment, the same as the first embodiment other than the following description, is shown in FIG. 11.

The elastic link member 11 has a bent portion 45 at a predetermined point, the bent portion 45 provided with a fixing means like a clip 47 for fastening the bent portion, whereby folding of the support member 9 and unfolding thereof are made possible without collapse thereof.

The bent portion 45 is bent from the inner side of the upper body 1 toward the outer side thereof to prevent release of the elastic link member 11 out of the joint portion with the hinge member 7 when the elastic link member 11 makes a linear movement.

Figure 12:
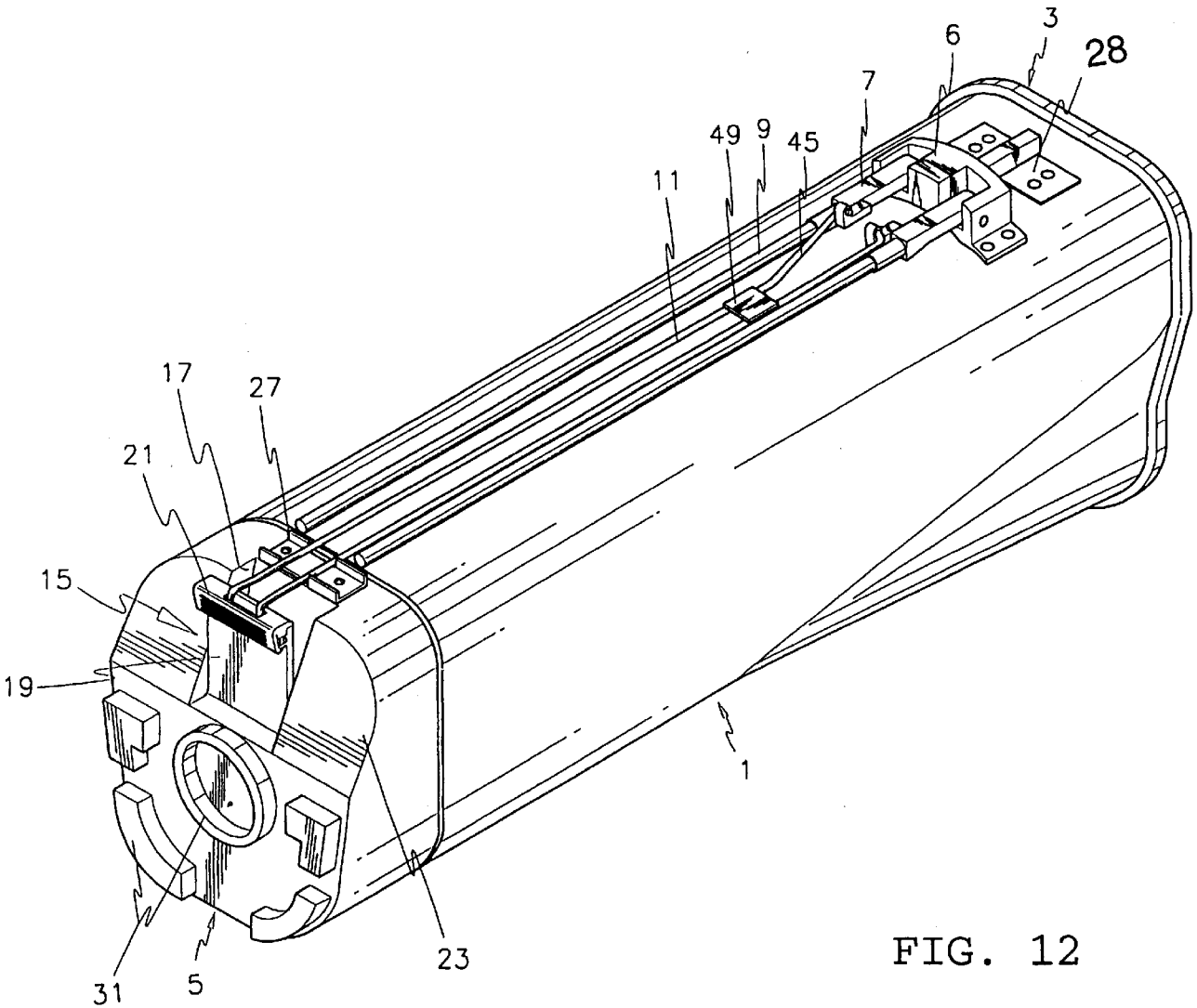
FIG. 12 is a perspective view showing a golf bag according to the sixth embodiment of the present invention.
Figure 13:
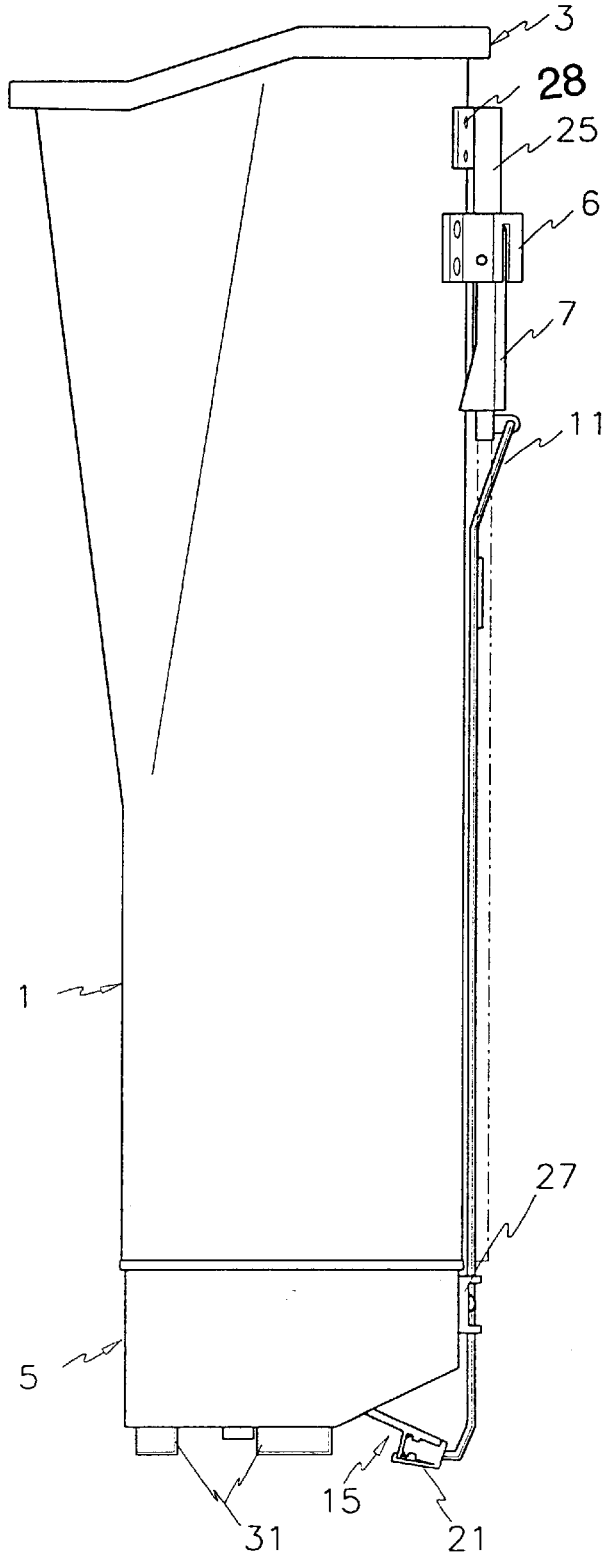
FIG. 13 is a side view showing a golf bag according to the sixth embodiment of the present invention.

A golf bag according to the sixth embodiment, the same as the first embodiment other than the following description, is shown in FIG. 12 and FIG. 13.

As shown in FIG. 12 and FIG. 13, in order to prevent release of the elastic member 11 from the hinge member 7 when the elastic link member 11 makes a linear movement, the bent portion 45 is preferably formed such that the bent portion is bent from the outer side of the hinge member 7 toward the inner side thereof and from the inner side of the upper body 1 toward the outer side thereof.

In addition, the elastic link member 11 is coupled with a fixed member 49 for fixing the elastic link members lest the elastic link member 11 should be broken when making a linear movement.

Figure 14:
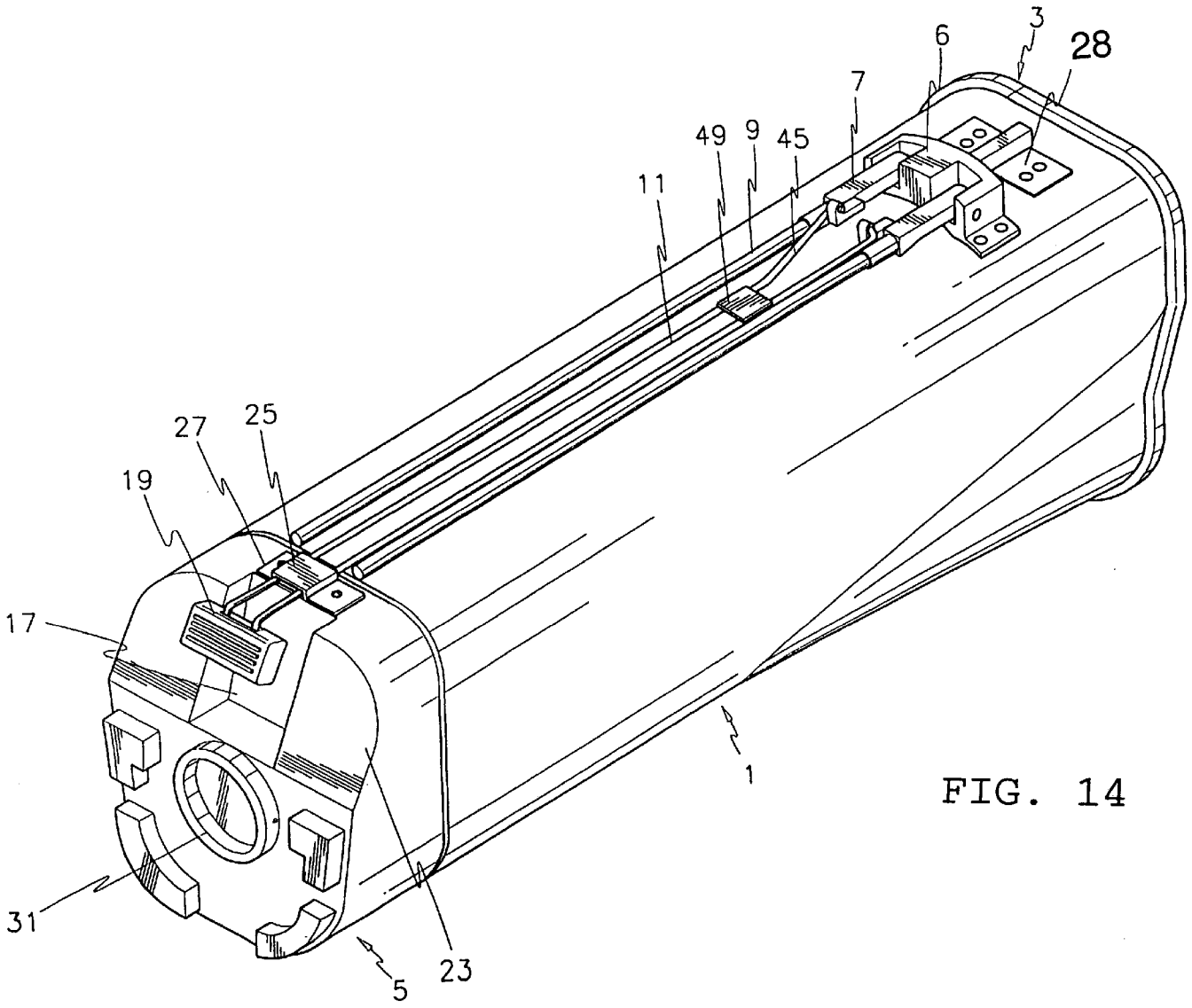
FIG. 14 is a perspective view showing a golf bag according to the seventh embodiment of the present invention.

The seventh embodiment of the present invention, the same as the first embodiment other than the following description, is shown in FIG. 14.

The pressing member 19 is coupled only to the free end of the elastic link member 11 to push up the elastic link member 11 when the lower body 5 touches the ground surface.

The elastic link member 11 has a bent portion 45 whereat the elastic link member 11 is bent from the outer side of the hinge member 7 toward the inner side thereof and from the inner side of the upper body 1 toward the outer side thereof (similar to FIG. 12 and FIG. 13), so when the elastic link member 11 is forced to make a linear movement by the pressing member 19, the same 11 may not be released from the hinge member 7 to operate properly.

The pressing member 19 is preferably formed in the same slant direction and slant angle as the slanted portion 23 for facilitating the linear movement of the pressing member 19 when the slanted portion of the bottom body 5 lands at the ground.

Figure 15:
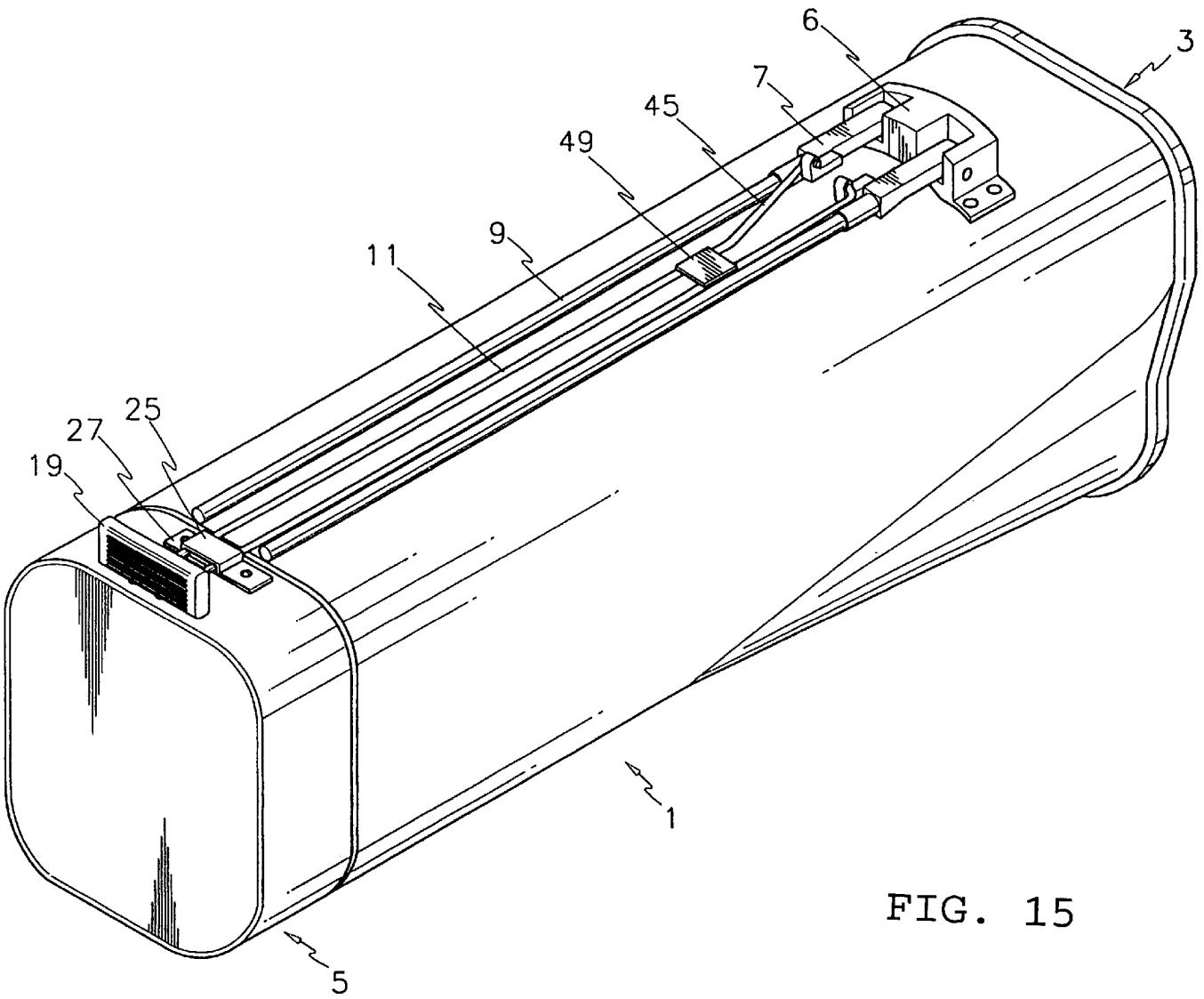
FIG. 15 is a perspective view showing a golf bag according to the eighth embodiment of the present invention.

The eighth embodiment of the present invention, the same as the first or seventh embodiment other than the following description, is shown in FIG. 15.

The bottom face of the lower body 5 is a plane, and the pressing member 19 for pushing up the elastic link member 11 to unfold the support member 9 when the lower body 5 is slanted is coupled to the free end of the elastic link member 11.

In addition, the free end of the elastic link member 11 should be reached beyond the bottom face of the lower body 5 to secure a predetermined reciprocal distance of the pressing member when the lower body is slanted.

Figure 16:
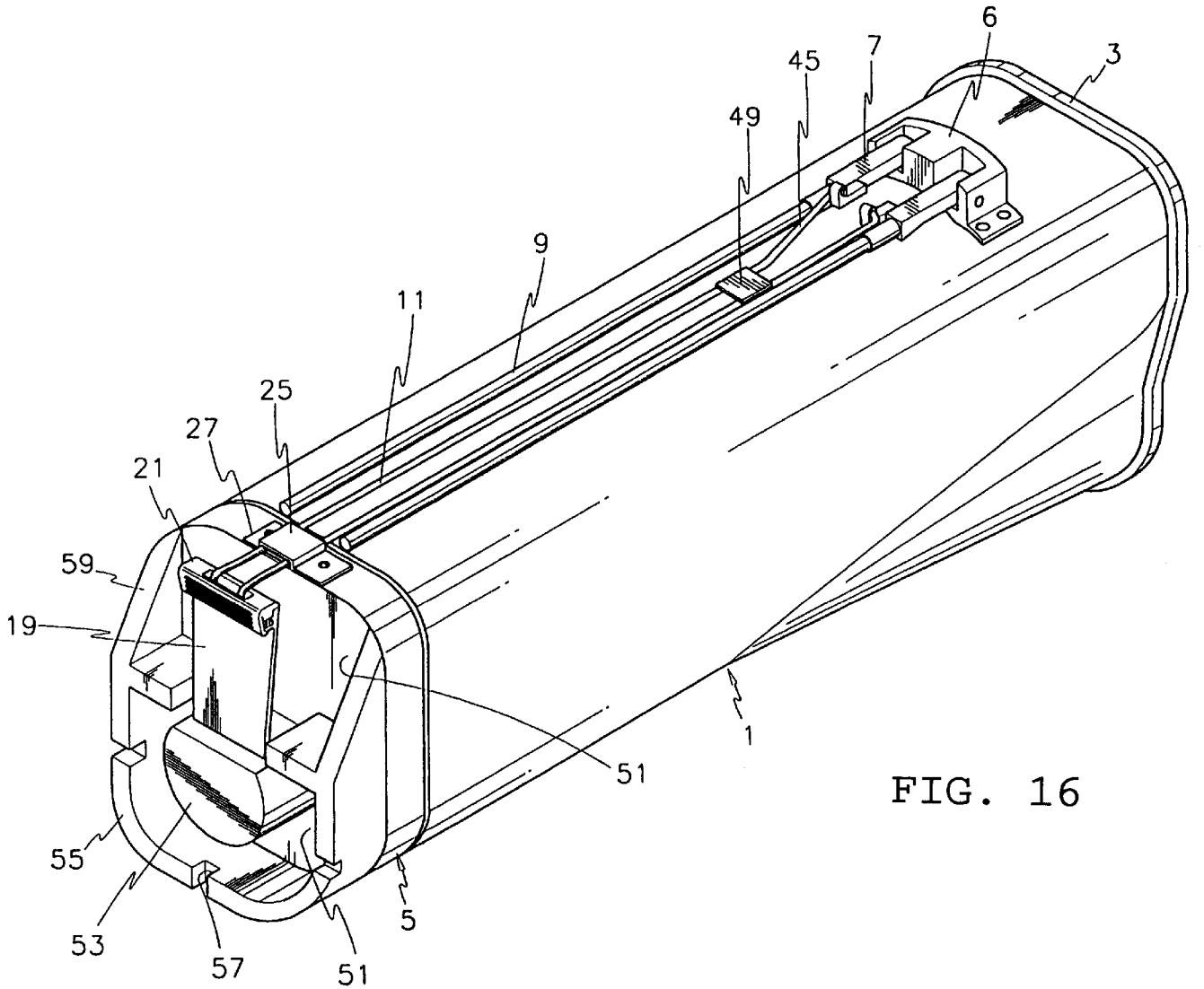
FIG. 16 is a perspective view showing a golf bag according to the ninth embodiment of the present invention.
Figure 17:
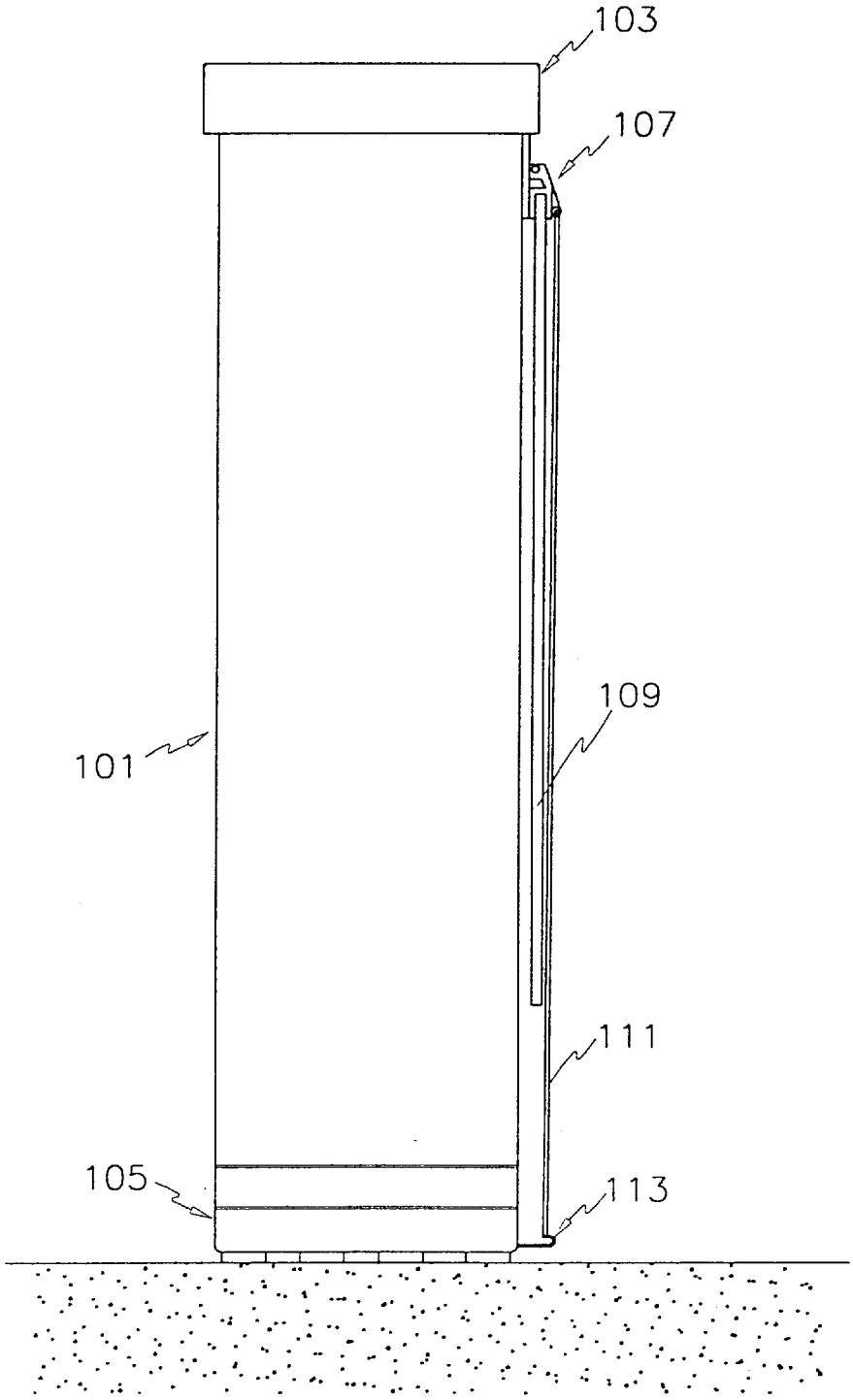
FIG.17 (PRIOR ART)
FIG. 17 is a draft showing a conventional golf bag.
Figure 18:
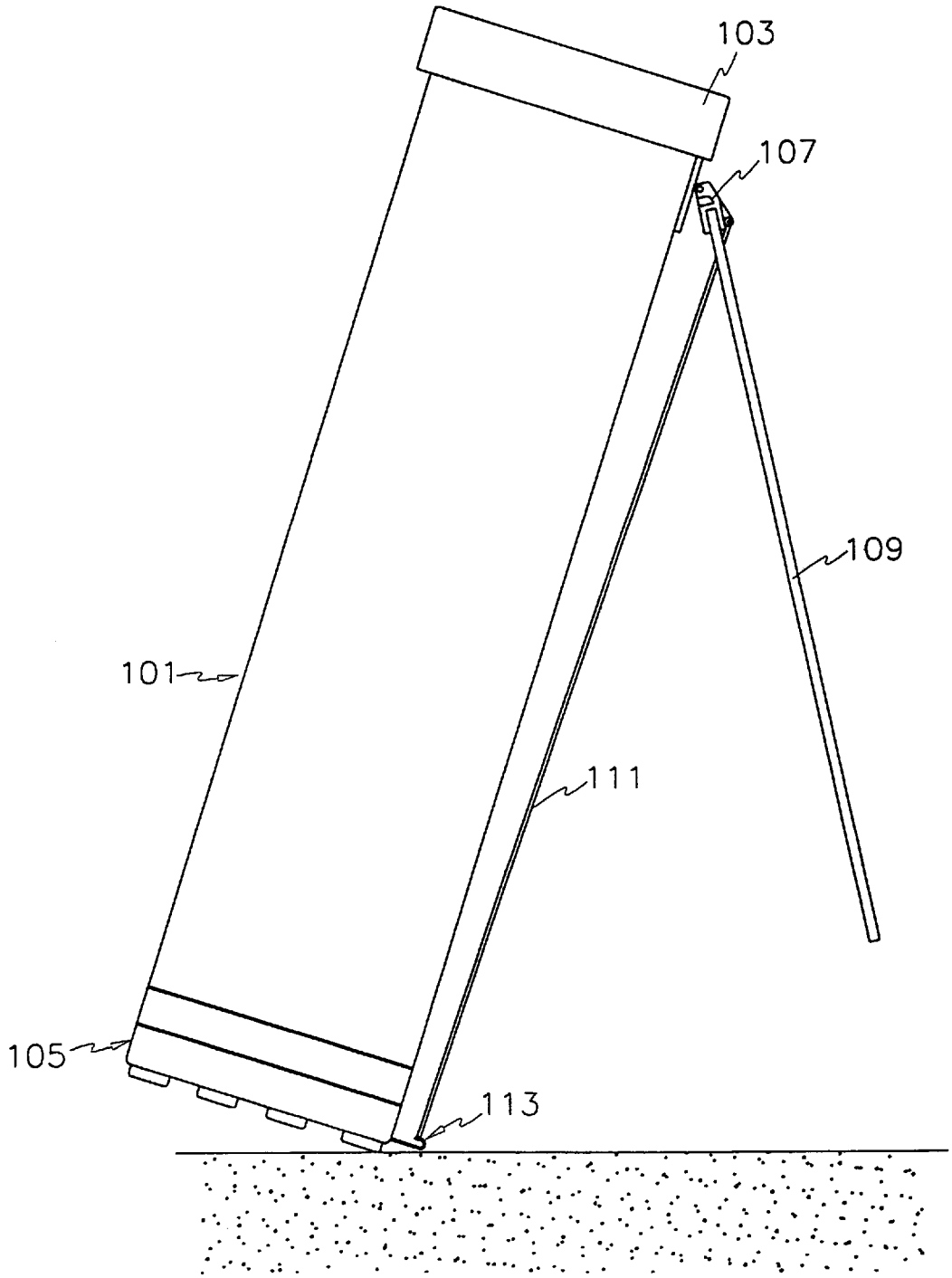
FIG.18 (PRIOR ART)
FIG. 18 is a draft showing an operation of a conventional golf bag.

The ninth embodiment of the present invention, the same as the first or seventh embodiment, is shown in FIG. 16.

Below the bottom face of the lower body 5 is provided inner and outer pad members 53 and 55, respectively forming a space portion 51 of a predetermined size for propping the lower body 5.

The inner pad member 53 is mounted such that the space portion 51 is formed wherein the pressing member 19 for pushing up the elastic link member 11 when the lower body 5 is slanted can have a predetermined reciprocal distance.

The outer pad member 55 comprises more-than-one depressed grooves 57 and a slanted portion 59 formed in some portion of the outer pad member 55 for facilitating an elevation of the elastic link member 11 by the pressing member 19 when the lower body 5 is slanted.

Consequently, the present invention formed in a unit structure, wherein when the lower body is slanted on the ground, the support member is unfolded, is preferred for reduced assembly processing steps, a fine viewing configuration, a reduced manufacturing cost, and a reduced occurrence of breakdown.

Although the preferred embodiment of the present invention has been described in detail hereinabove, it should be clearly understood that many variations and/or modifications of the basic inventive concepts herein taught which may appear to those skilled in the present art still fall within the spirit and scope of the present invention, as defined in the appended claims.

What is claimed is:

1. A golf bag, comprising:

an upper body having a cylindrical structure configuration, an upper portion, and a lower portion;

a frame mounted in the upper portion to maintain the cylindrical structure configuration aaainst at least one of an external force and an internal force caused by a weight of a collection of golf clubs disposed within the golf bag;

a lower body disposed about the lower portion of the upper body;

a plurality of fixing members coupled to the upper body;

a plurality of hinge members, each hinge member pivotally coupled to a fixing member, each hinge member having a free end;

a plurality of support members, each support member coupled to a free end of a hinge member, wherein each support member is to be unfolded when the upper body is slanted so as to retain the golf bag at a predetermined angle;

means for folding and unfolding the plurality of support members;

a pressing member;

more-than-one inside and outside pad members disposed in a lower face of the lower body to form space portions of a predetermined size in a lower portion of the lower body and to prop the lower body, where the pressing member is connected to an inside pad member such that the pressing member is used to push up an elastic link member when the lower body is titled on the ground and is allowed to have a constant reciprocal distance inside a space formed between the more-than-one inside and outside pad members.

2. The golf bag of claim 1, wherein a slanted portion is formed in an outside pad member wherethrough the pressing member moves up the elastic link member when the lower body is tilted.

3. A golf bag, comprising:

a body that defines an upper portion and a lower portion, the lower portion defining a perimeter and having a pressing member, the pressing member having a fixed end and a free end, wherein the fixed end is fixedly coupled to the lower portion within the perimeter of the lower portion;

a first support member having a first end and a second end, wherein the first end of the first support member is pivotally coupled to the upper portion;

a first elastic link member having a first end and a second end, wherein the first end of the first elastic link member is coupled to the first support member at a location that is between the first end and the second end of the first support member, and wherein the second end of the first elastic link member is coupled to the free end of the pressing member, wherein the upper portion is located in an upper body, wherein the lower portion is located in a lower body, the lower body having a slanted portion disposed in a bottom face of the lower body; and a connection member coupled to the first elastic link member and snap fit into the free end of the pressing member.

4. The golf bag of claim 3, the lower body having an allowance space disposed within the lower body about the pressing member to permit the pressing member to make a reciprocal movement of a predetermined length.

5. The golf bag of claim 3, wherein the first end of the first support member having a stopper, a first position, and a second position, wherein the first end of the first support resides in the second position when the stopper contacts the upper portion.

6. A golf bag, comprising:

a body that defines an upper portion and a lower portion, the lower portion defining a perimeter and having a pressing member, the pressing member having a fixed end and a free end, wherein the fixed end is fixedly coupled to the lower portion within the perimeter of the lower portion;

a first support member having a first end and a second end, wherein the first end of the first support member is pivotally coupled to the upper portion;

a first elastic link member having a first end and a second end, wherein the first end of the first elastic link member is coupled to the first support member at a location that is between the first end and the second end of the first support member, and wherein the second end of the first elastic link member is coupled to the free end of the pressing member, the first elastic link member having a length; and a guide member fixed to the body, the guide member having an interior having a length, wherein the first elastic link member is disposed within the interior of the guide member, and wherein the interior length of the guide member is greater than one half the length of the first elastic link member.

7. The golf bag of claim 4, further comprising:

a second support member having a first end and a second end, wherein the first end of the second support member is pivotally coupled to the upper portion;

a second elastic link member having a first end and a second end, wherein the first end of the second elastic member is coupled to the second support member at a location that is between the first end and the second end of the second support member, and wherein the second end of the second elastic link member is coupled to the free end of the pressing member, wherein the second elastic link member is disposed within the interior of the guide member; and a clip disposed about the first elastic link member and the second elastic link member at a location that is remote from the interior of the guide member.

8. The golf bag of claim 7, wherein at least one of the first elastic link member and the second elastic link member includes a bent portion, wherein the bent portion is disposed between the clip and at least one of the first elastic link member and the second elastic link member, and wherein the bent portion is bent from an inner side of the upper portion of the body towards an outside thereof.

9. The golf bag of claim 8, wherein each of the first end of the first support member and the first end of the second support member is pivotally coupled to the upper portion by a hinged member, and wherein the bent portion further is bent from an outer side of the hinged member toward the inner side thereof.

10. A golf bag, comprising:

a body that defines an upper portion and a lower portion, the lower portion defining a perimeter and having a pressing member, the pressing member having a fixed end and a free end, wherein the fixed end is fixedly coupled to the lower portion within the perimeter of the lower portion;

a first support member having a first end and a second end, wherein the first end of the first support member is pivotally coupled to the upper portion; and a first elastic link member having a first end and a second end, wherein the first end of the first elastic link member is coupled to the first support member at a location that is between the first end and the second end of the first support member, and wherein the second end of the first elastic link member is coupled to the free end of the pressing member, the lower body having an inner pad member that defines a space portion, wherein the pressing member is coupled to the inner pad member and disposed within the space portion, wherein the inner pad member and the space portion permit the pressing member to make a reciprocal movement between two fixed points.

11. The golf bag of claim 10, wherein the upper portion is located is an upper body, wherein the lower portion is located in a lower body, the lower body further having an outside pad member, the pad member having a slanted portion disposed therein to permit the pressing member to move the first elastic link member in an up direction when the lower body is tilted.

* * * * *

UNITED STATES PATENT AND TRADEMARK OFFICE

CERTIFICATE OF CORRECTION

PATENT NO. : 6,220,433 B1
DATED : April 24, 2001
INVENTOR(S) : Kang

It is certified that error appears in the above-identified patent and that said Letters Patent is hereby corrected as shown below:

Claim 1,
Line 5, please delete "aaainst" and insert -- against --.

Claim 7,
Line 1, please delete "claim 4" and insert -- claim 6 --.

Signed and Sealed this

First Day of January, 2002

*Attest:*

*Attesting Officer*

JAMES E. ROGAN
*Director of the United States Patent and Trademark Office*